US005385521A

United States Patent [19]

Weissbuch

[11] Patent Number: 5,385,521

[45] Date of Patent: Jan. 31, 1995

[54] AQUATIC EXERCISE DEVICE

[76] Inventor: Sanford S. Weissbuch, 2276 S. Beverly Glen Blvd., No. 202, Los Angeles, Calif. 90064

[21] Appl. No.: 81,166

[22] Filed: Jun. 25, 1993

[51] Int. Cl.[6] ..... A63B 31/00

[52] U.S. Cl. ..... 482/55; 482/111; 434/254; 441/106; 441/114

[58] Field of Search ..... 482/55, 105, 111; 434/254; 441/55, 60, 65, 88, 106, 108, 111, 114, 117, 119, 125, 129, 56, 58, 136; 472/128, 129; D21/228, 236–239; 128/869, 870; 602/19

[56] References Cited

U.S. PATENT DOCUMENTS

D. 187,764 4/1960 Rodriquez .
D. 195,384 6/1963 Del Mar ..... D21/228
D. 197,820 3/1964 Baker ..... D21/238
D. 265,116 6/1982 Churchill ..... D21/228
D. 315,010 2/1991 Stevens .
D. 319,485 8/1991 Scheurer ..... D21/236
D. 320,059 9/1991 Bedortha et al. .
D. 323,541 1/1992 Ciolino .
D. 329,633 9/1992 Rogers, Jr. ..... D21/237
676,359 6/1901 Gair .
727,444 5/1903 Recordon .
803,910 11/1905 Ledermann .
1,446,099 2/1923 Marks .
1,478,239 12/1923 Marengo et al. .
1,506,359 8/1924 Bower .
1,538,627 5/1925 DiLauro .
1,617,061 2/1927 La Pierre .
1,713,733 5/1929 Anderson .
1,715,571 6/1929 Robertson ..... 441/58
2,802,222 8/1957 Chapman .
2,889,830 6/1959 Raymond .
2,898,610 8/1959 Chamberlain .
2,935,751 5/1960 Emmick et al. .
2,940,453 6/1960 Lerner .
3,049,735 8/1962 Baker .
3,077,618 2/1963 O'Link .
3,094,725 6/1963 Martin, Jr. .
3,101,492 8/1963 Martin .
3,134,995 6/1964 Kirchner ..... 441/117
3,137,015 6/1964 Lindeman .
3,183,530 5/1965 Girden .
3,416,172 12/1968 Gerling .
3,425,072 2/1969 Carlson .
3,427,020 2/1969 Montour et al. .
3,913,907 10/1975 Baker ..... 441/56
4,123,814 11/1978 Ettinger .
4,300,759 11/1981 Caplan .
4,362,518 12/1982 Boissiere ..... 441/88
4,547,165 10/1985 Scheurer et al. .
4,575,075 3/1986 Tarbox et al. .
4,689,030 8/1987 McWaters .
4,721,300 1/1988 Guzman .
4,813,668 3/1989 Solloway .
4,842,562 6/1989 Supal .
4,905,991 3/1990 Alston .
4,951,940 8/1990 Vitello et al. .
4,997,183 3/1991 Winston .
5,000,710 3/1991 Bedortha et al. .
5,092,802 3/1992 Jones .
5,102,120 4/1992 Lindblad .
5,169,371 12/1992 Holmes .
5,184,993 2/1993 Dowdeswell .

*Primary Examiner*—Richard J. Apley
*Assistant Examiner*—Jeanne M. Mollo
*Attorney, Agent, or Firm*—Merchant & Gould

[57] ABSTRACT

An aquatic exercise device which has a dual configuration of (1) a hand-held buoyancy swimming kickboard; and (2) a buoyancy device worn around the human's midsection. The device is a buoyant board element which is substantially elongated, of greater length than width, and having large surface areas at opposite sides thereof and without lateral extending flaps. Affixed to and/or projecting from the buoyant board element are opposing limbs of band element which extend at least about 20% of the board length. When secured around the human midsection, the device is used for exercise in deep water to support the human in a relatively or substantially vertical position. This allows upright exercise while the human is freely suspended with the head and most or all of the neck above water, and the lower extremities bearing no weight, feet not touching bottom. When the band is folded and/or wrapped and fastened around the board or removed, the board can be used for exercise in water as a kickboard.

22 Claims, 2 Drawing Sheets

AQUATIC EXERCISE DEVICE

BACKGROUND

Having a versatile aquatic exercise device for facilitating upright and horizontal aquatic exercise is valuable.

This invention involves an aquatic exercise device. In particular, the invention is directed to a multi-purpose aquatic exercise device.

Aquatic exercise in the horizontal and upright positions is recognized as an excellent conditioner of the cardiovascular system and body musculature leading to increased endurance, strength, mobility, flexibility and overall physical fitness and sense of well-being while causing little or no stress or trauma upon weight-bearing joints and averting possible injuries associated with land based exercise.

Additionally, aquatic exercise in water less than body temperature allows for rapid dissipation of excess body heat, essentially preventing overheating.

An additional benefit of aquatic exercise is that it can be done in the safety and privacy of a backyard or community swimming pool.

A hand-held upper extremity embraced buoyancy device is a swimming kickboard. This allows the user's upper body to remain stationary, namely resting the upper body, arms and hands and facilitating the raising of the head above water. Exercise can be focused upon the large lower body musculature, utilizing flutter, frog or dolphin kick lower extremity motion. This conditions the cardiovascular system, strengthens the lower extremities and improves kick technique.

Deep water upright exercise buoyancy devices allow the user to exercise and condition the cardiovascular system, upper and lower extremities and most of the remaining body musculature. The user has free use of his upper and lower extremities and thus can for example run, jog, walk or "rock climb" in deep water, not touching bottom. Water provides for resistance to motion in all directions of the submerged body part and resistance increases with more rapid motion.

Deep water upright exercise buoyancy devices are known. These are, however, often poorly fitting, uncomfortable for small or overweight users, and unflattering in appearance when used by overweight users.

These known devices do not provide the additional function of being an effective hand-held buoyancy device, so-called swimming kickboard.

Further, these known devices are not readily adjustable for accommodating larger and/or heavier individual users.

Additionally, there are solid flotation devices which are intended as swimming aids. These are positioned posterior to the lumbar and/or thoracic regions of the user's body. These solid devices, however, pose a possible danger to the user because of the tendency of these devices to rise or ride-upward causing the superior end or aspect of the device to lie posterior to the neck/cervical spine region, a relatively vulnerable region of the spinal column. A sudden hyperextension force/whiplash could cause severe damage to the neck/cervical spine due to the fulcrum effect of the upper end or aspect of the solid flotation device.

No presently-known aquatic exercise device effectively serves as a hand-held buoyancy device and a deep water upright exercise buoyancy device.

There is need for such an aquatic exercise device. Such device should be designed to (a) limit the possibility of cervical spine injury;
(b) be easily and securely fastened and quickly removed;
(c) be comfortable and readily adjustable to fit a very wide range of users of variable body habitus;
(d) have favorable appearance characteristics when worn;
(e) be readily adjusted for larger or heavier individuals for total buoyancy; and
(f) be simple in construction and assembly, inexpensive to manufacture, easily maintained and rugged and durable in use.

SUMMARY

The present invention provides an aquatic exercise device which seeks to meet the above needs.

According to the invention, an aquatic exercise device comprises a relatively flat and elongated buoyant board element, and a band affixed with the board. The board has opposite surface areas which are relatively large. The band is adapted to releasably secure a flat face of the board adjacent to a human body.

The band is relatively broad such that the width of the band extends at least about 20% of the length of the board. Preferably, the band extends to at least about 25% to about 33% of the length of the board. The band is preferably located in the lower half of the board.

There are means for releasably affixing the band with the board. The band preferably includes at least one free end. The free end includes fastening means whereby the band can be fastened with a mating fastening means selectively on the board or on an opposite free end of the band.

Aperture means permits the band to be threaded through the board thereby affixing the band and board together. The band would act to positively secure the board to the back of a human when the board is strapped to the human.

The board includes a bottom, top, opposite sides and opposite relatively flat or large area surfaces. The apertures, which are at least two slots, are spaced apart and towards the sides of the board. The board can be relatively thicker towards the bottom than towards the top.

Upright aquatic exercise is accomplished by strapping the buoyant board element adjacent to the back of a human. The board is removably affixed on the back. The human would be held in a floating position substantially upright in water. This may be in a range between 0°, and preferably 10° to 30° relative to a vertical position. This allows the user to exercise in the upright position without weight bearing upon the lower extremities.

When the board is not used for upright aquatic exercise, the band can be fastened around the board. Alternatively, the band can be removed from the board.

The device can also be used as a hand-held buoyancy device, so-called swimming kickboard.

The invention is further described with reference to the accompanying drawings.

DRAWINGS

Figure 1:
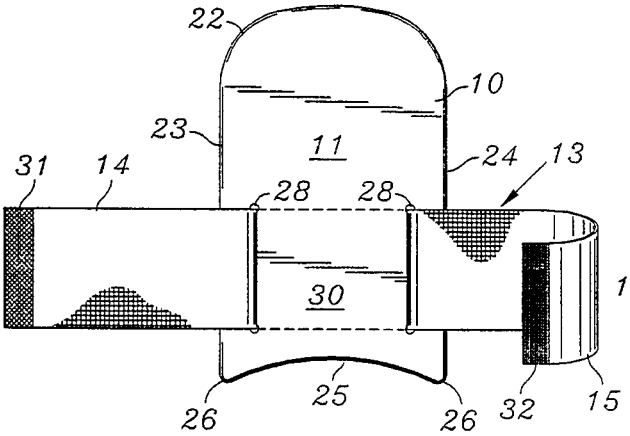
FIG. 1 is a front view of a board with the band intertwined through apertures in the board.
Figure 2:
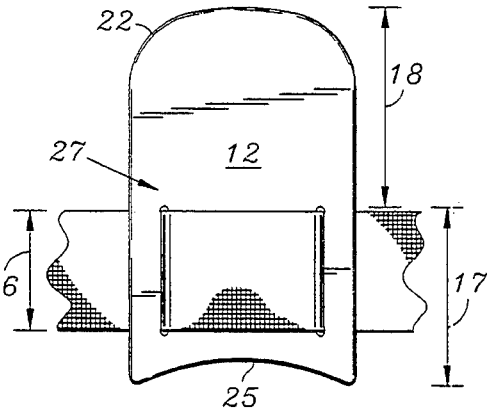
FIG. 2 is a rear view of the board with the band intertwined through the apertures.
Figure 4:
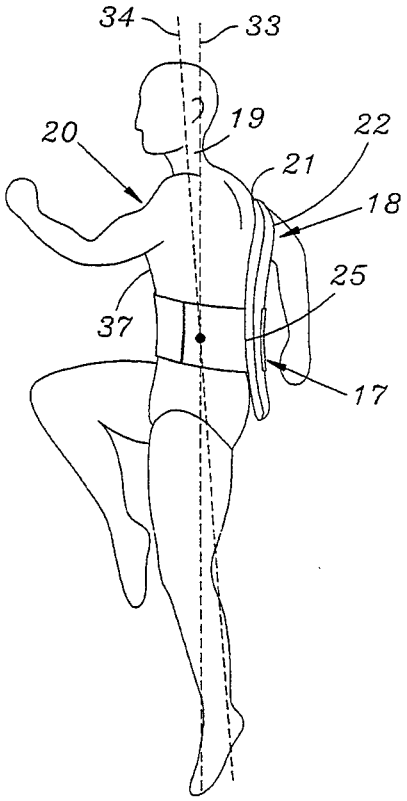
Figure 3:
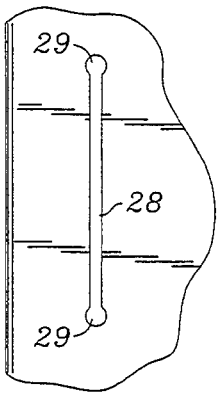
FIG. 3 is a detailed view of the aperture in the board.

FIG. 4 is a view of the device worn by a human with the band affixed around the waist of the human. The board is held in close contact to the user's posterior body torso, namely the back of the user. The board has slightly curved surfaces.

Figure 5:
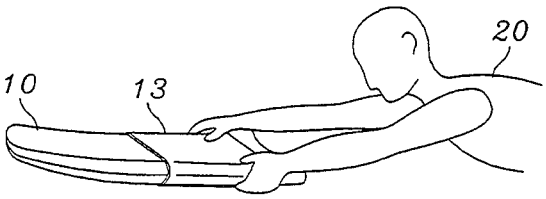

FIG. 5 is a view of the board with the band wrapped and/or folded and fastened around the buoyant board element for hand-held buoyancy, as a swimming kickboard. The board has relatively flat surfaces.

Figure 6:
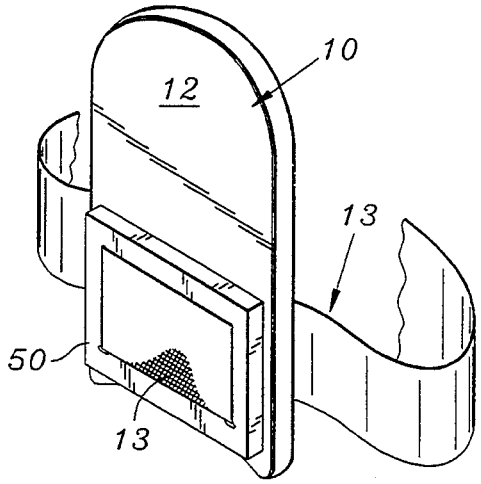

FIG. 6 is a view of the board and band with auxiliary buoyancy blocks or plates.

Figure 7:
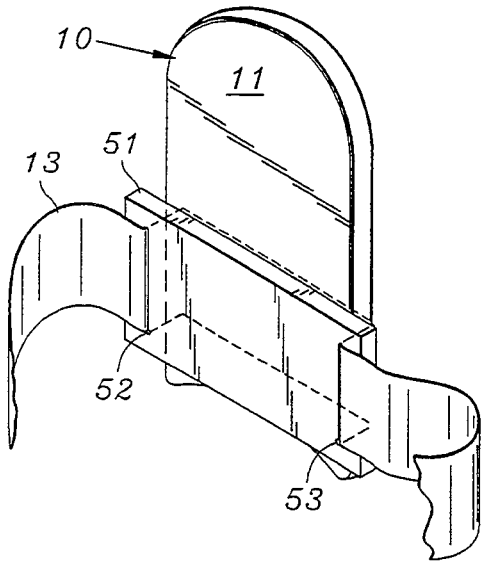

FIG. 7 is a view of the board and band with a different embodiment of the auxiliary buoyancy block or plate.

Figure 8:
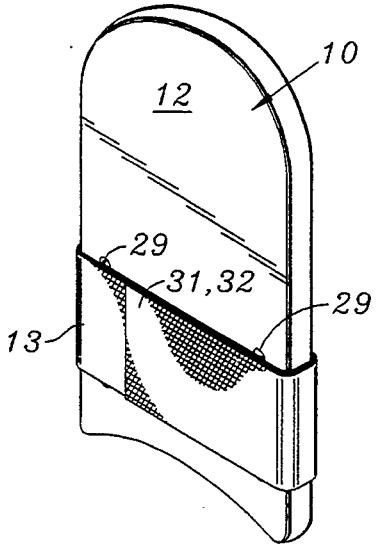

FIG. 8 is a detailed view with the band wrapped around the buoyant board and fastened with a hook and pile mechanical adhesive such as Velcro TM.

Figure 9:
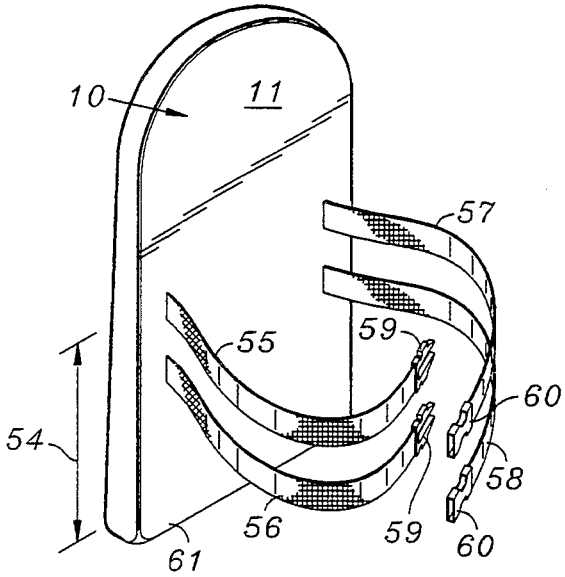

FIG. 9 is a view of a different board and different band.

DESCRIPTION

The aquatic exercise device has a dual configuration and dual purpose. Firstly, the device acts as a hand-held buoyancy device, namely as a swimming kickboard.

In a second configuration, the aquatic exercise device is worn around a human body midsection for use in deep water to support the user in a relatively upright position. More specifically, the device supports the user in a substantially or relatively upright position or in a slightly forwardly inclined 0°–30° position. This allows upright exercise while the user's body is freely suspended with head and most or all of the neck above water. The lower extremities bear no weight, with the feet not touching the bottom.

The aquatic exercise device includes a board 10 of buoyant material. The board 10 is substantially elongated, namely of greater length than width and having relatively large opposite surface areas 11 and 12. These surfaces 11 and 12 may be flat faced or gently curved to facilitate fitting to the back of a user, and/or use as a kickboard.

Affixed to and/or projecting from the buoyant board 10 is a band 13. The band 13 is relatively broad and has opposing limbs 14 and 15. The breadth of the band is about 3" to 10" in width. The opposing limbs 14 and 15 of the band 13 are located lateral to the board 10 and substantially in the lower half 17 of the buoyant board 10.

Buoyant Board

The buoyant board 10 is constructed of closed cell foam plastic such as Ethylene Vinyl Acetate (EVA) and/or closed cell foam plastic laminate or closed cell foam and non-foam plastic laminate. Such a board is obtainable from Sentinal Water Sports, a division of Packaging Industries Corp. Inc. of 130 North Street, Hyannis, Mass. 02601. EVA is obtainable from the Rubatex Corporation of Bedford, Va. 24523.

The board 10 is substantially flexible in its superior portion 18, such that it may flex or bend away, posteriorly, from a recoiling head/neck 19 of a human user 20. Additionally, the superior edge 21 of the board may be beveled away from the user 20.

The mid portion 27 and lower portion 17 of the board 10 are relatively firm or rigid while being somewhat bendable. This assures durability and strength and the stable fixation of the band 13 to the board 10, and user comfort.

The relative flexibility and rigidity of the board 10 is achieved by varying board thickness and/or varying density and other physical properties of board constituents.

The buoyancy may be modified by changes in buoyant board 10 thickness, overall board size, and position of the buoyant board 10 relative to the user 20.

The preferred shape of the buoyant board 10 has a superior aspect which has an outwardly convex curved hydrodynamic shape 22 and to help facilitate superior portion flexibility. Laterally, the board 10 has straight and parallel sides 23 and 24. The bottom 25 of the board 10 is inwardly concave with round corners 26, which increases user comfort when the board 10 is held against the chest 37 of the user 20 when the device is used as a swimming kickboard. The edges are flat along the inferior and lateral aspects and flat or beveled along the upper aspect of the user's side 11 when worn. The thickness of the board 10 which is an integral unit, is substantially uniform and relatively thin compared to the length and board width.

The buoyant board 10 is constructed with two lengthwise elongated narrow, less than about ¼ inch wide, slot-like apertures 28, one on either side of the lower 50%–75% of the board 10. This results in the formation of a single relatively wide central section or strut 30 lying medial to both narrow slots 28. There are two relatively narrow lateral sections to each side of the narrow slots 28. On either end of the elongated narrow slots 28, there is a rounding or a circular expansion aperture 29. These expansion apertures 29 help prevent the narrow slots 28 from enlarging with device use. They also permit escape of any entrapped water or air.

Band

The broad wide band 13 is constructed of durable elasticized and/or non-elasticized materials. The inside of the band 13 which contacts or faces the user's skin may be of a somewhat coarse texture so as to provide additional "purchase". Such a band 13, known as Solar Belt TM is obtainable from Bollinger Industries of 222 West Airport Freeway, Irving, Tex. 75062.

The band 13 is located with, attached to, affixed to, or molded into the buoyant board 10 in any of numerous manners.

The limbs 14 and 15 projecting from buoyant board 10 may originate from one long single band of material or two separate segments or pieces of band material which are:

(1) directly affixed to the buoyant board with glue, staples, mechanically or chemical adhesives; or
(2) molded or laminated into the board; or
(3) affixed with the aid of slots or apertures of various shapes made within the board. Additionally, the material may be further affixed with glue, staples, mechanically or chemical adhesives; or
(4) attached or sewed to loops or other fastening device which emerges from or are attached to the board itself.

These fastening devices or loops may be directly attached to a band, which originate from the board 10 in numerous manners similar to those described above, or which are affixed directly to the board 10.

In the preferred embodiment, the band 13 of elasticized material intertwines or traverses through the elongated narrow slots 28 within the buoyant board 10. The band 13 loops around the single wide central section or strut 30. As such two opposing paired limbs 14 and 15 of the band material project through the elongated slots 28, in front of the board surface 11. The band 13 posteriorly lies flush with surface 12.

The separate broad band 13 of elasticized material may have fabric bonded to at least one side of its surfaces. A Velcro TM or Velcro TM -like strip or strips 31 and 32 can be affixed to an end of the side surface opposite the fabric bonded side. The strips 31 and 32 facilitate fastening the band 13 about the waist of the human 20.

Use of Board and Band

The broad band 13 is positioned and snugly wrapped and releasably fastened around the waist and beneath the rib cage of a human 20. This provides stable positioning of the buoyant board 10 in its intended position and alignment, close to the posterior body torso (lumbosacral and thoracic spinal regions and well beneath the neck/cervical region). In this position, the board 10 and band 13 is comfortably located. The device is readily adjustable, and fits a wide range of users of varying body shapes. The device appears waist-trimming and form-flattering in its fit, even to overweight users.

When used with the human 20 vertical, the human can be located along the vertical axis 33 or vary up to about 3020 from vertical as shown diagrammatically by line 34. This facilitates aquatic upright exercise such as running and jogging.

When used with the human 20 horizontal, the board 10 can be held ahead of the human 20. The band 13 is wrapped around the board 10. The elasticized characteristics can facilitate that strips 31 and 32 interact to ensure that the band is tightly held about the board 10.

Buoyancy may be adjusted by use of an auxiliary block or plate 50 or 51 of buoyant material, made of similar material as the primary buoyant board 10. The auxiliary buoyant material 50 or 51 may be of various thicknesses and shapes and have slot-like apertures 52 and 53 on each of the two opposing sides. The auxiliary block or plate 50 or 51 of buoyant material may be affixed or held in place close to the primary buoyant board 10 by inserting and passing the limbs of the band 13 through the apertures 52 and 53 on either side of auxiliary block 50 or 51 of buoyant material as illustrated. The auxiliary block 50 or 51 is held adjacent to the lower half of board 10. In FIG. 6, the auxiliary board 50 is adjacent the surface 12. In FIG. 7, the board 51 is adjacent to the surface 11.

In FIG. 9, a board is shown with a threaded lower portion 54. There are multiple separate spaced body bands 55, 56, 57 and 58. Buckles 59 and 60 interengage and bands 55 to 58 can be adjustable, elasticized or non-elasticized. The ends of the bands 55 to 58 remote from the buckles are affixed with the board 10 by suitable adhesives and/or mechanical affixation as previously described. The bottom 61 is flat.

General

There can be innumerable variations in buoyant board, band and auxiliary blocks or plates. The shape, contour and construction of the board, band and auxiliary block or plates can be changed in a manner which does not depart or substantially change the intended functions of the device.

The elongated buoyant board 10, for example, may have a top aspect which is straight, pointed, polygonal, or be other shapes. The bottom aspect may be either straight or have other shapes. Surfaces 11 and 12 may be curved inwardly or outwardly. At least one, and preferably both, surfaces 11 and 12 is sufficiently flat to facilitate effective use as a kickboard. The edges may be beveled, faceted, rounded, or have other shapes. The thickness of the board 10 may vary in different portions. The lateral aspects may be converging/diverging or curved inward or outward. There may be variations in flexibility and rigidity in different portions of the board 10.

The apertures 28 along the lateral board aspects, when and if present, may vary in number, shape and course such as converging/diverging.

Notches on the lateral margins of the board 10, when and if present, may vary in shape and number.

In alternative embodiments of the band 13, there are multiple opposing limbs of narrower band material which are spaced apart.

Additionally, the band material, may have uniform width. Alternatively the material may be tapered or forked to achieve better fit, comfort and proper positioning. Moreso, the location of the band relative to the board can be changed, for instance, it may be centered about the board or located in some other different position on the board.

In place of Velcro TM closure elements, buckles such as 59 to 60 or the like can be used to secure the band 13 about the body, or board.

One or more additional narrower bands may be used to ensure positive location of the upper portion of the board relative to the human when the device is worn by the human for upright aquatic exercise.

While the invention has been described with particularity, it is clear that many changes may be made in the detail of construction without departing from the spirit and scope of the disclosure. It is understood that the invention is not limited to the described embodiments. The scope of the invention is to be determined solely by the following claims.

I claim:

1. An aquatic exercise device comprising:

an elongated buoyant board element having a relatively flat face, the board being generally planar and being without lateral extending flaps and being sized and configured to fit adjacent to the back of a human body, and band means affixed with the board whereby the band means is adapted to releasably secure the flat face of the board adjacent to the back of the human body, the band means being of a length sufficient that at least together with the board, the band means together with the board is able to surround the torso of the body with the board being located adjacent to the back of the human body, and wherein the overall width of the band means extends at least about 20% of the board length, and wherein the band means is located essentially in a lower portion of the board element and not in an upper portion of the board element.

2. An aquatic device as claimed in claim 1 wherein the width of the band extends at least about 25% of the length of the board.

3. An aquatic device as claimed in claim 1 wherein the width of the band extends at least about 33% of the length of the board.

4. An aquatic device as claimed in claim 1 including means for releasably affixing the band with the board.

5. An aquatic device as claimed in claim 1 wherein the band means includes at least one free end, the free end including fastening means whereby the band means is fastenable with a mating fastening means on the board or on an opposite free end of the band.

6. An aquatic device as claimed in claim 5 wherein the fastening means includes hook and pile fastening means.

7. An aquatic device as claimed in claim 1 wherein the board includes aperture means, the aperture means permitting the band to be threaded through the board thereby affixing together the band and board.

8. An aquatic device as claimed in claim 7 wherein the apertures are elongated slots, the slots being directed along the board length.

9. An aquatic device as claimed in claim 1 wherein the board includes a bottom, top, opposite sides and opposite relative flat surfaces, at least two elongated slots spaced apart and towards the sides of the board.

10. An aquatic device as claimed in claim 1 wherein the board includes a bottom, top, opposite sides and opposite relatively flat surfaces, the board top being relatively convex.

11. An aquatic device as claimed in claim 1 wherein the band means is elasticized.

12. An aquatic device as claimed in claim 1 wherein the board is an integral unit including a top and a bottom, and wherein the board is relatively thicker towards the bottom than towards the top, the board thickness overall being relatively thin in relation to the board length and board width.

13. An aquatic device as claimed in claim 1 including an auxiliary buoyant element, the auxiliary buoyant element being removable affixed to the board.

14. A device as claimed in claim 1 wherein the band means includes multiple elements.

15. A device as claimed in claim 14 including fastening means, the fastening means being at least one of a group consisting of hook and pile fastening means, flexible releasable grippers or buckles.

16. An aquatic device as claimed in claim 1 including an auxiliary buoyant element, the auxiliary buoyant element being removably located relative to the board.

17. An aquatic exercise device for permitting dual purpose exercising by a human, such device selectively being (a) a hand-held buoyant swimming kickboard or (b) a buoyancy device worn around a human midsection for use in deep water supporting the user in a substantially upright position, allowing upright exercise while the human is suspended with the head and at least part of the neck above water, and the lower extremities bearing little weight the device comprising a buoyant board element being substantially elongated, having opposite large surface areas, being generally planar and without lateral extending flaps, and being sized and configured to fit adjacent to the back of a human body, and band means affixed to the board for selectively locating the board in a strapped position about the human midsection for use firstly as a user-worn buoyancy device, the band means being of a length sufficient that at least together with he board, the band means together with the board is able to surround the torso of the body with the board being located adjacent to the back of the human body, and wherein the overall width of the band means extends at least about 20% of a board length, and wherein the band means is located essentially in a lower portion of the board element and not in an upper portion of the board element, or located in a position with or removed from the board for use secondly as a hand-held kickboard.

18. A device as claimed in claim 17 wherein the band means includes fastening means, the fastening means being at least one of a group consisting of hook and pile fastening means, flexible releasable grippers or buckles.

19. A device as claimed in claim 17 including an auxiliary buoyant element, the auxiliary buoyant element being removable affixed to the board.

20. A device as claimed in claim 17 wherein the buoyant board includes a material defining the board, the material being of a relatively flexible constituency at least in an upper portion of the board relative to the material in a lower portion of the board.

21. A device as claimed in claim 17 wherein the band means includes multiple elements.

22. A device as claimed in claim 17 including an auxiliary buoyant element, the auxiliary buoyant element being removable located relative to the board.

* * * * *